United States Patent [19]

Frolov

[11] Patent Number: 4,843,851

[45] Date of Patent: Jul. 4, 1989

[54] LOCKING MECHANISM FOR MULTIFUNCTIONAL ELECTRONIC LOCK

[75] Inventor: George Frolov, Farmington, Conn.

[73] Assignee: Emhart Industries Inc., Farmington, Conn.

[21] Appl. No.: 99,937

[22] Filed: Sep. 23, 1987

[51] Int. Cl.[4] ..... E05B 47/00

[52] U.S. Cl. ..... 70/277; 70/279; 70/150

[58] Field of Search ..... 70/277–280, 70/150, 151 A, 151 R

[56] References Cited

U.S. PATENT DOCUMENTS

| | | | |
|---|---|---|---|
| 580,820 | 4/1897 | Scheeren | 70/277 X |
| 1,948,217 | 2/1934 | Goodwin, Sr. | 70/280 |
| 2,222,553 | 11/1940 | Raymond | 70/279 X |
| 2,224,671 | 12/1940 | Crooks | 70/151 |
| 2,765,648 | 10/1956 | Hatcher | 70/264 |
| 3,266,277 | 8/1966 | Chesler | 70/150 |
| 3,336,770 | 8/1967 | Parsons | 70/277 X |
| 3,893,723 | 7/1975 | Boule | 292/146 |
| 3,897,093 | 7/1975 | Wiczer | 292/144 |
| 4,099,752 | 7/1978 | Geringer | 70/279 X |
| 4,132,439 | 1/1979 | Millar | 292/144 |
| 4,148,092 | 4/1979 | Martin | 361/172 |
| 4,434,635 | 3/1984 | Borgato | 70/279 |
| 4,594,864 | 6/1986 | Hart | 70/143 |

FOREIGN PATENT DOCUMENTS

| | | | |
|---|---|---|---|
| 2736353 | 2/1979 | Fed. Rep. of Germany | 70/280 |
| 3543527 | 6/1987 | Fed. Rep. of Germany | 70/279 |
| 331054 | 8/1903 | France | 70/279 |

*Primary Examiner*—Robert L. Wolfe
*Assistant Examiner*—Suzanne L. Dino
*Attorney, Agent, or Firm*—Barry E. Deutsch

[57] ABSTRACT

An electronic door locking apparatus which can perform a number of functions is provided. The apparatus features a locking plate which is operated by solenoid action in such a manner that battery drain is minimized. The apparatus may remain in an unlocked position for long periods of time without draining power.

12 Claims, 6 Drawing Sheets

LOCKING MECHANISM FOR MULTIFUNCTIONAL ELECTRONIC LOCK

BACKGROUND OF THE INVENTION

1. FIELD OF THE INVENTION

The invention relates to a multifunctional electronic door locking apparatus. More particularly, the invention relates to a novel locking mechanism for an electronic door lock featuring a locking plate operated by solenoid action.

2. DESCRIPTION OF THE PRIOR ART

Electronic door locks are known to the art. Most electronic door locks, however, can provide only a single method of operation or function. For example, electronic locks having a so called hotel function are set to open upon insertion of a proper key card, remain open for a predetermined amount of time, usually 3–6 seconds, and then automatically lock again. If the user does not gain entry within the predetermined time, the key card must be inserted again and the process will start anew.

Prior art electronic door locks having the hotel function are typically battery powered and utilize a single solenoid to provide the locking function. Such locks ar constructed such that the solenoid is energized for the time that the lock is in the unlocked position. Thus, if the lock remains open for 3–6 seconds, the solenoid draws power and drains the battery for that amount of time. With this type of lock it is almost impossible to provide a different function, for example, a dormitory or classroom function that will leave the lock open for indefinite periods of time, because such functions would consume batteries at an unacceptable rate.

It is known to utilize solenoids in various configurations for electronic door locking apparatus. For example, U.S. Pat. No. 4,132,439 discloses an electronic door lock in which the lock bolt is moved longitudinally by a first solenoid and in which a dead bolt element is moved by a second solenoid.

U.S. Pat. No. 4,148,092 describes an electronic door lock with a manually operable deadbolt. This lock features a single solenoid positioned such that its plunger is received by a cavity in the manual turning mechanism thereby preventing the lock from being opened manually.

U.S. Pat. No. 3,893,723 describes an electronically operated door lock in which two solenoids are disposed opposite each other to lock and unlock the door by moving the locking pin into and out of a cavity in the wall.

U.S. Pat. No. 2,224,671 describes an automobile door lock which utilizes a single solenoid instead of a locking spring as a means to prevent opening of the lock.

U.S. Pat. No. 2,765,648 discloses an electronic lock for an automobile in which the lock bolt is actuated by a solenoid and a bar actuated by another solenoid is provided to extend into a notch of the lock bolt to retain the lock bolt in the locked position.

U.S. Pat. No. 3,897,093 discloses an electronic door lock in which two solenoids actuate a pivotally mounted cradle which provides reciprocal movement of the lock bolt.

U.S. Pat. No. 4,594,864 discloses a mechanical lockset assembly which includes an actuating member, cam plate, locking plate and pinion. The lockset described in this patent could not be operated by solenoids due to the interaction of the locking plate and pinion.

None of these patents disclose the novel locking mechanism of the present invention.

SUMMARY OF THE INVENTION

The invention provides an electronic door lock which can be adapted to perform a number of different functions More specifically, the invention provides a locking mechanism for an electronic lock which can be maintained in either a locked or unlocked position without drawing power. The locking mechanism comprises a locking plate operated by solenoid action. The locking plate is moved vertically between lower locked and upper unlocked positions by the action of main solenoid means located on the sides of the locking plate. Auxiliary solenoid means are provided so that the locking plate can be maintained in either the upper unlocked position or the lower locked position without drawing any power.

In the lower locked position, the locking plate engages a locking pin connected to an actuating member which in turn is connected to to the outside lever. In this position, the lever is prevented from being turned and the lock is prevented from being opened by the constraints of the locking plate and sides on the locking pin. In the upper unlocked position, the locking plate does not engage the locking pin and there are no constraints to prevent the lever from being turned to withdraw the latch bolt and open the lock.

The locking plate is moved vertically between the upper and lower positions by main solenoid means located at the sides of the locking plate. An important feature of the present invention is the presence of auxiliary solenoid means positioned near the top of the locking plate. The auxiliary solenoid means operates to alternatively restrict the movement of the locking plate to either its upper or lower locked position or to permit movement between these two positions. More specifically, the auxiliary solenoid means is positioned so that its shaft is perpendicular to the locking plate when the locking plate is in the lower locked position. The shaft is received in a slot near the top of the locking plate. In this position, the shaft of the auxiliary solenoid means prevents the locking plate from being raised which in turn results in the locking plate continuing to engage the locking pin attached to the actuating member and prevents the lever from turning. In the lower locked position, neither the main nor the auxiliary solenoid means are energized and they do not draw any power.

When it is desired for the locking plate to be raised to its upper position, the shaft of the auxiliary solenoid means is withdrawn so that it no longer is in the path of the locking plate. The locking plate can then be raised to the upper position by the action of the main solenoid means, passing the withdrawn shaft of the auxiliary solenoid. The main and auxiliary solenoid means are energized only when the locking plate is moving between positions, which generally involves a time of approximately tenths of a second. When the locking plate reaches the upper position, the shaft of the auxiliary solenoid means is again extended by the action of a spring, and it is received in another slot in the locking plate. The locking plate then rests upon the shaft of the auxiliary solenoid and is maintained in the upper position. In the upper unlocked position neither the main nor auxiliary solenoid means are energized and they do not draw power. Thus, either the upper unlocked or the lower locked positions can be maintained without drawing any power.

DESCRIPTION OF THE PREFERRED EMBODIMENT

Figure 1:
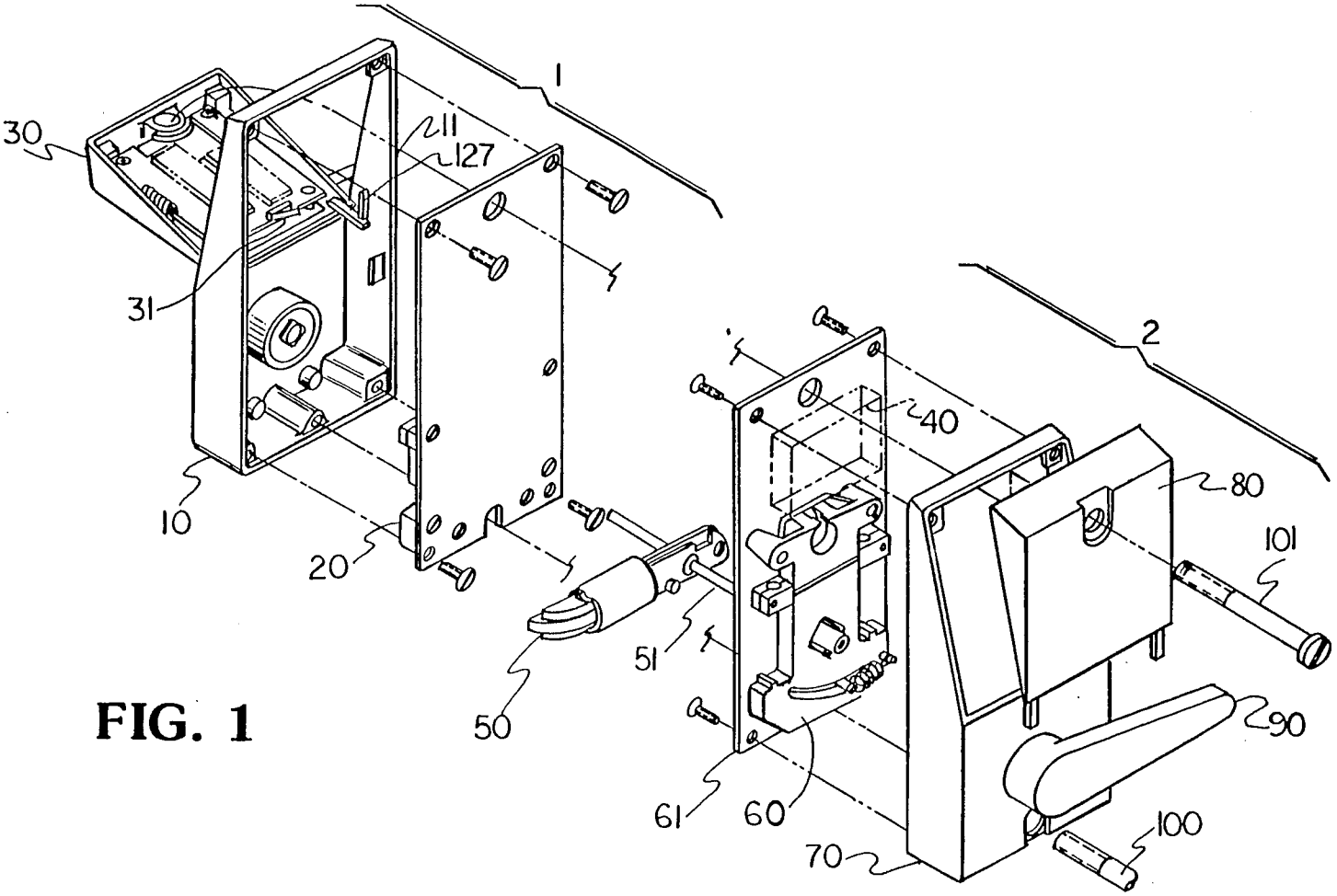
FIG. 1 is an exploded view of an electronic lock according to the present invention.

Referring to FIG. 1, the preferred electronic door lock in accordance with the present invention comprises an outside portion 1, a latch bolt assembly 50, which includes spindle 51, and an inside portion 2. Outside portion 1 includes outside housing 10, outside lever 11, outside operating assembly 20 which is shown attached to plate 21 and which includes the locking mechanism, and outside cover 30. Inside portion 2 includes power source 40 and inside operating assembly 60, which are shown attached to plate 61, inside housing 70, inside cover 80 and inside lever 90. Plates 21 and 61, which include the outside and inside operating assemblies, are attached to housings 10 and 70, respectively, by means of screws, as shown. The entire electronic lock is held in place when mounted on a door by screws 100 and 101. A strike box and strike plate (not shown) are mounted on the door jamb in a conventional manner.

Outside cover 30 contains a card reader device and the electronic and logic circuitry. A suitable card reader device for an electronic door lock in accordance with the present invention is described in commonly assigned application Ser. No. 099,929, filed on an even date herewith, and entitled "Improved Card Reader", the contents of which are incorporated by reference. Suitable circuitry for a card reader is described in commonly assigned Ser. No. 099,924, filed on even date herewith and entitled "Improved Code Reader", the contents of which was incorporated by reference. Suitable electronic and logic circuitry for an electronic door lock in accordance with the present invention is described in application commonly assigned Ser. No. 099,921, filed on an even date herewith and entitled "Control For Electronic Lock", the contents of which are incorporated by reference. Outside cover 30 may also contain a battery power sensing system of the type described commonly assigned Ser. No. 031,712, filed Mar. 27, 1987, entitled "Curtailed Power Delivery in Electronic Lock", the contents of which are incorporated by reference.

Figure 2:
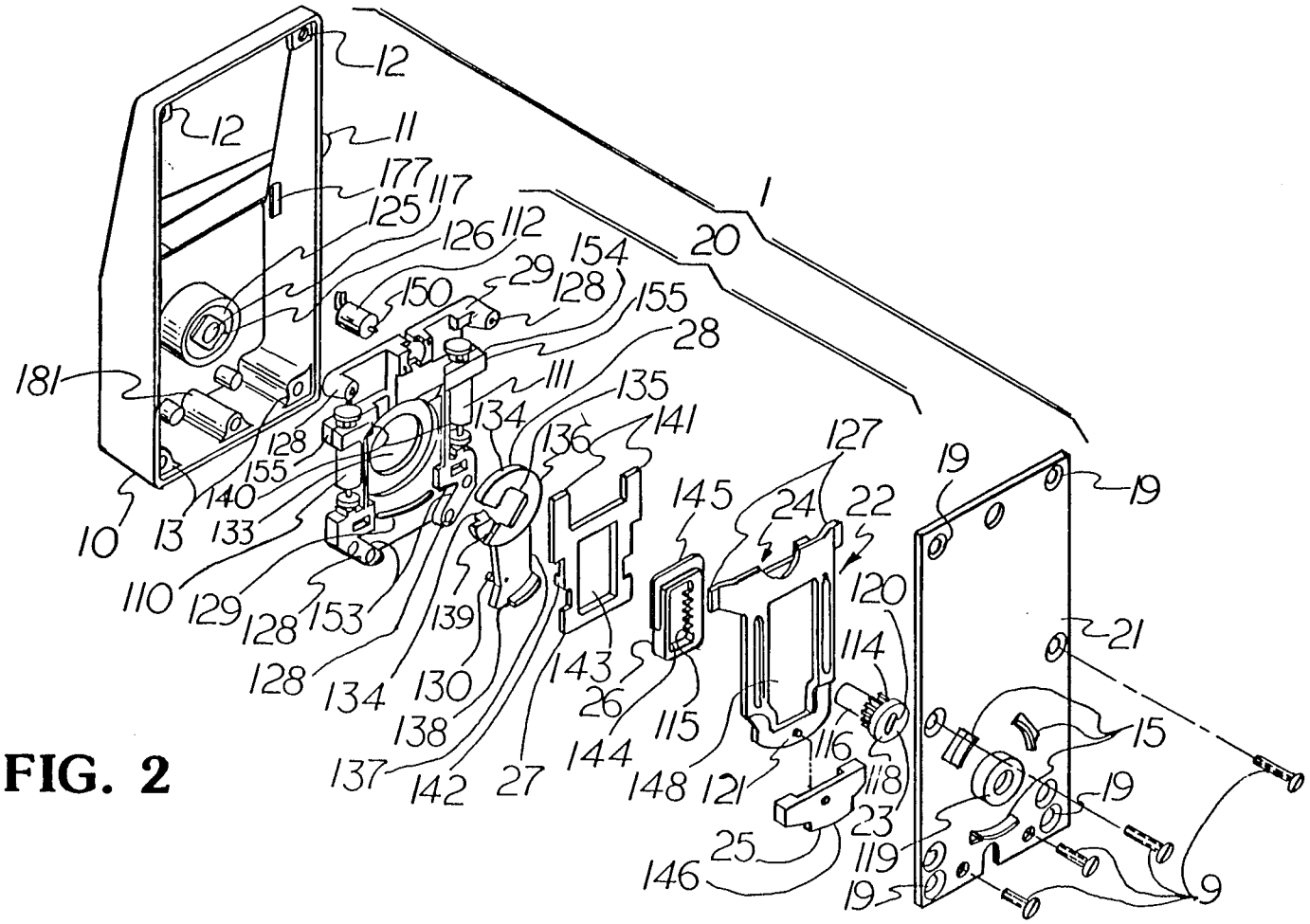
FIG. 2 is an exploded view of the outside portion of an electronic lock including the novel locking mechanism of the present invention.

Referring to FIG. 2, outside portion 1 is described in greater detail. Outside operating assembly 20 comprises lock cassette body 29, which supports main solenoids 110 and 111 and auxiliary solenoid 112, an actuating member 28, a cam plate 27, a rack plate 26, a locking plate which includes two parts, a top plate 24 and a nose piece 25, and a pinion 23.

Back plate 21 contains holes 19 through which it may be attached by screws (shown in FIG. 1) to tabs 12 and bosses 13 in housing 10. Back plate 21 also contains tabs 15 to align the assembly with a standard hole provided in a door. Back plate 21 is provided with boss 119 which extends inwardly and provides a bearing surface for head 118 of pinion 23. The outside operating assembly is attached to back plate 21 by screws 9 into threaded holes 128 in bosses on lock cassette body 29. Such attachment serves to hold together the entire outside operating assembly.

Housing 10 features a central opening 125 into which a generally square shaped projection 126 of outside lever 11 extends. Tabs 177 are positioned so that projecting legs of the outside cover 30 can rest and maintain the cover in a generally horizontal position for servicing (shown in FIG. 1). Threaded hole 181 is provided to receive screw 100 (shown in FIG. 1).

Lock cassette body 29 supports main solenoids 110 and 111 as well as auxiliary solenoid 112. Main solenoids 110 and 111 are positioned on lock cassette body 29 to engage ears 127 of top plate 24 so as to vertically lift the locking plate between lower locked and upper unlocked positions, as will be described in greater detail in connection with FIGS. 4 to 10. The main solenoids are attached to the lock cassette body 29 by screw and bracket support 155. Shafts 154 of the main solenoids extend through vertical holes in supports 155. Auxiliary solenoid 112 is positioned on lock cassette body 29 so that its shaft 150 is perpendicular to top plate 24 and engages slots therein, as will be described in connection with FIGS. 4 to 10. A slot 129 is provided through which actuator pin 130 of actuating member 28 fits. Vertical sides 140 define a pathway which accommodate projecting arms 141 of cam plate 27. Lock cassette body 29 also features an opening 133 through which projection 126 of outside lever 11 extends. Threaded holes 128 are provided to attach the entire outside operation assembly to back plate 21.

Figure 11:
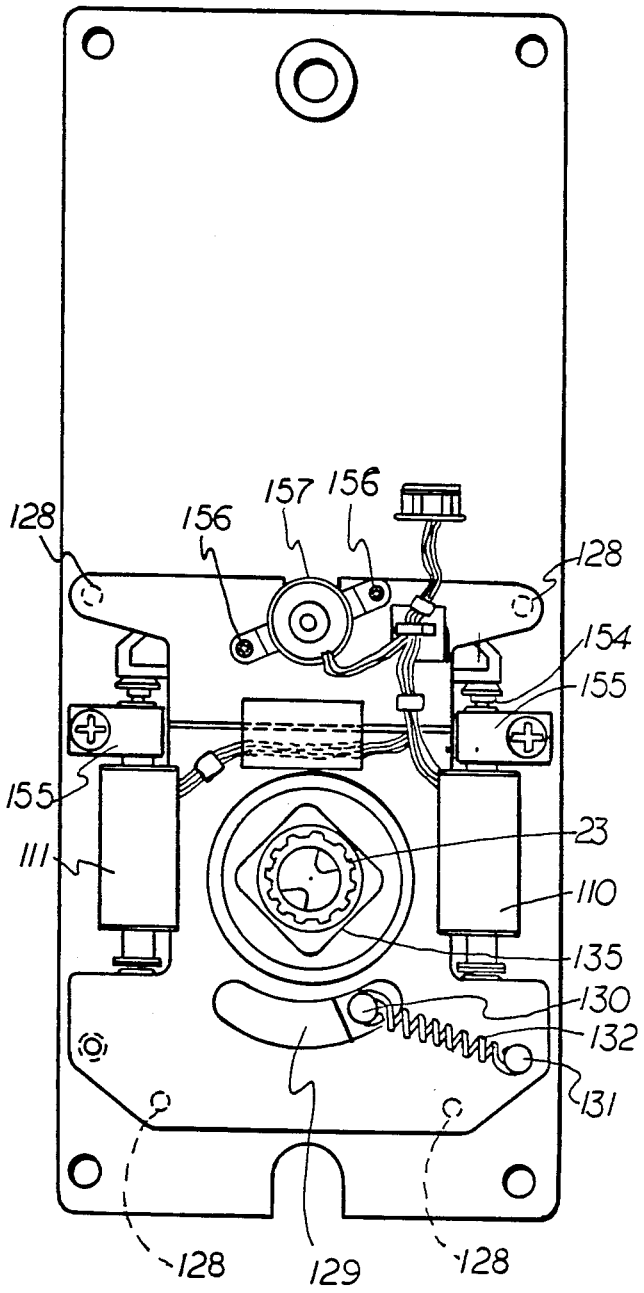
FIG. 11 shows the outside operating assembly including the novel locking mechanism of the present invention mounted on the back plate of the outside portion.

Referring to FIG. 11 to complete the description of lock cassette body 29, a spring mounting pin 131 is included on the outward, side. Extension spring 132 fits onto pin 130 of actuating member 28 and spring mounting pin 131. The auxiliary solenoid is attached to lock cassette body 29 by means of screws 156 and generally circular bracket 157.

Referring again to FIG. 2, actuating member 28 is mounted on the inward side of cassette body 29 with a boss 134 thereof mounted in opening 133 and actuator pin 130 fitting through slot 129. The actuator 28 includes a generally square shaped opening 135 into which extends the generally square shaped projection 126 of lever 11. The actuator includes a circular shaped base portion 136 and a tail end 137 which supports the actuator pin 130 and a locking pin 138. The base portion 136 is provided with a raised V-shaped cam surface 139 which extends inwardly past the plane of the inner surface of tail end 137.

Cam plate 27 contains projecting arms 141 which fit into the pathway defined by vertical sides 140 of lock cassette body 29. The cam plate 27 also includes cam follower surface 142 which engages V-shaped cam 139 of actuator 28. Cam follower surface 142 is a tab projecting from the cam plate. Generally rectangular internal cutout 143 of cam plate 27 is sized to accommodate rack plate 26.

Rack plate 26 is mounted within the cutout 143 of cam plate 27. Rack plate 26 has a generally rectangular internal cutout 114 which cutout contains gear teeth 115 on one of the longer or vertical sides. Gear teeth 115 engage teeth 144 of pinion 23. Rack 26 has lip 145 upon its upper portion which serves to hold rack 26 in place between cam plate 27 and top plate 24. Rack plate 26 is able to move within cutout portion 148 of top plate 24 without changing the position, i.e. either locked or unlocked, of the locking plate. This allows the inside door lever to be opened without unlocking outside locking portion 1 of the lock.

The locking plate comprises two parts, a top plate 24 and a nose piece 25. Top plate 24 includes ears 127 which engage main solenoids 110 and 111 and apertures, such as slots, holes, depressions or openings 151 and 152 (shown in FIG. 4) which engage shaft 150 of auxiliary solenoid 112. Internal cutout 148 is provided to accommodate rack plate 26 and is sized so that rack 26 can move vertically without changing the position of the locking plate. Top plate 24 may be produced from any suitable material, however, it is preferred that it be produced from a light weight and strong material. These properties can be provided by any of a number of plastic materials; however, it is particularly preferred that the material be resistant to flame. One material which meets these criteria is sold by General Electric under the Trademark Lexan. It is contemplated that equivalent materials may also be employed without affecting the overall operation of the locking mechanism of the present invention.

Forming the top plate 24 from the light weight materials contemplated above has the advantage of reducing the power consumption needed by the solenoids to lift the locking plate, which is especially significant in a battery operated lock. Such materials also permit smaller solenoid size which reduces the overall size of the lock and leads to a greater battery life. Finally, such materials provide lubricity which decreases friction and leads to greater battery life.

Nose piece 25 of the locking plate may also be produced from any suitable material, however, it is preferred that it be produced from a metal such as hardened steel or stainless steel so that it will possess the strength to engage locking pin 138 and prevent actuating member 28 and outside lock lever 11 from moving. Equivalent metals or other materials may also be employed. Nose piece 25 is attached to the top plate 24 by pressing onto pin 121 on top plate 24. Adhesive may also be utilized to attach the nose piece to the top plate. Nose piece 25 includes protrusion 146 for engaging locking pin 138.

Pinion member 23 includes gear teeth 114 in mating engagement with the teeth 115 on rack plate 26. The pinion member 23 extends perpendicularly to the axis of the latch bolt assembly 50. Pinion member 23 also includes a tubular extension portion 116 which extends through top plate 24, rack 26, cam plate 27, actuator 28 and cassette body 29 into an opening 117 in outside lever 11. The pinion 23 further includes head portion 118 which is contained within boss 119 which extends inwardly on back plate 21 and provides a bearing surface for head portion 118. The head portion 118 also has a generally rectangular slot 120 therein of mating cross section with that of spindle 51 of latch bolt assembly 50 (shown in FIG. 1) which extends therethrough.

A suitable latch bolt assembly for the electronic door lock in accordance with the present invention is described in U.S. Pat. No. 4,594,864. The latch bolt is caused to be withdrawn by movement of outside lever 11. This is accomplished as follows. Turning lever 11 rotates square shaped projection 126 which rotates actuator 28, which in turn moves cam plate 27 in a vertical direction. The movement of cam plate 28 carries with it rack plate 26. As rack plate 26 moves upwardly it causes pinion 23 to rotate, thus rotating spindle 51 and withdrawing the latch bolt of latch mechanism 50.

Referring to FIGS. 4-10, the operation of the locking mechanism will be described in greater detail.

Figure 4:
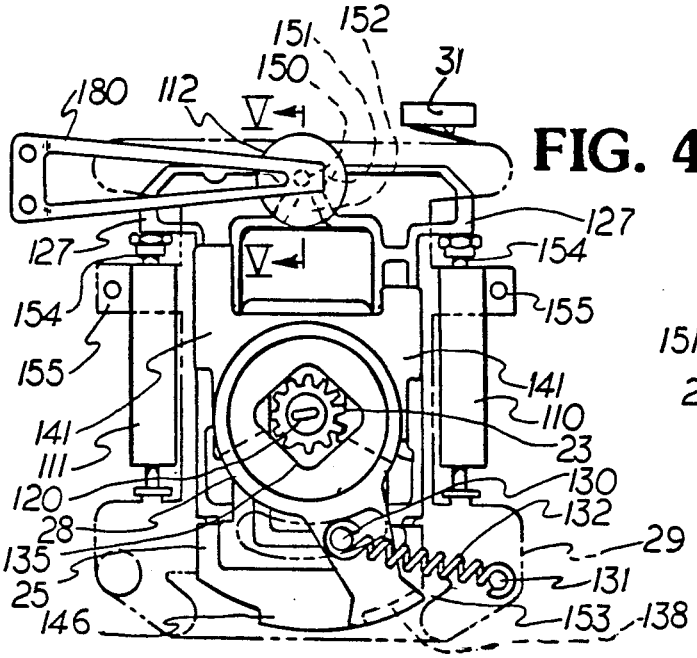
FIGS. 4–10 show detail of the operation of the locking plate and solenoid means of the present invention.

FIG. 4 depicts the locking plate in the lower locked position. In this position, locking pin 138 engages protrusion 146 of the nose piece portion 25 of the locking plate. Locking pin 138 is constrained from movement by protrusion 146 of nose piece 25 and the wall 153 of lock cassette body 29. Locking pin 138 is attached to actuating member 28, which in turn engages the lock lever by means of generally square shaped projection 126 which fits into aperture 135 of actuating member 28. By preventing movement of the locking pin, the lever is also effectively prevented from moving and the lock cannot be opened.

Figure 7:
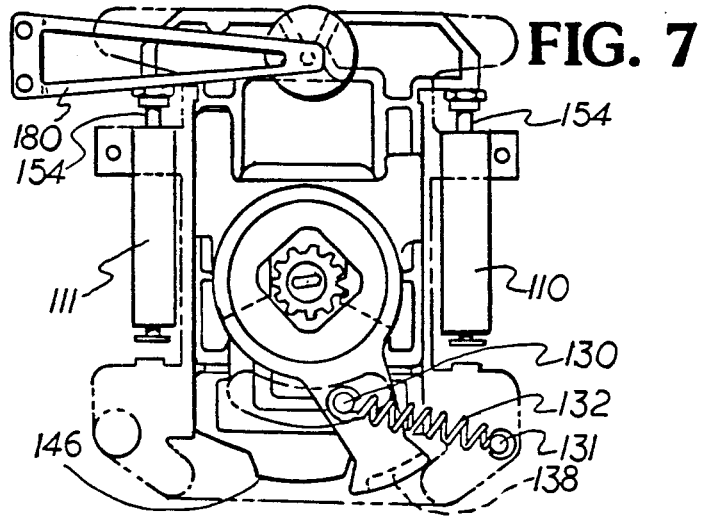
Figure 10:
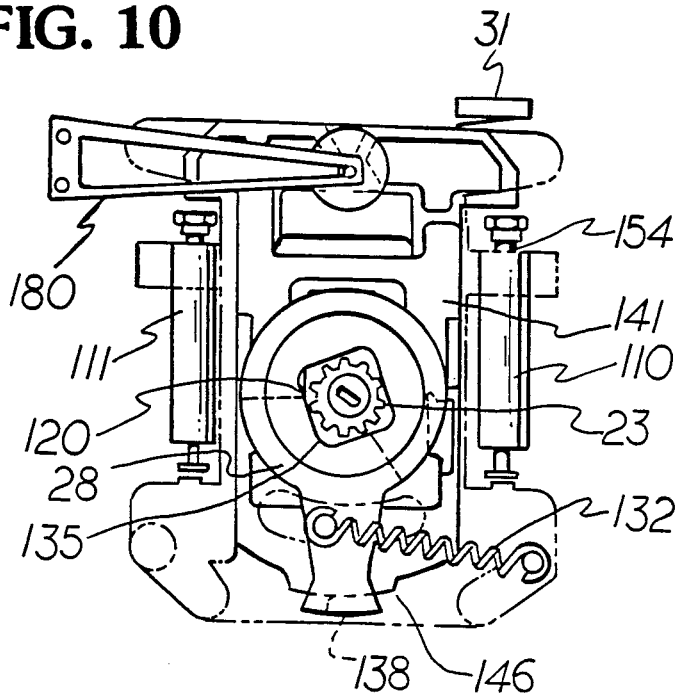

FIGS. 7 and 10 depict the locking plate in the upper unlocked position. In this position, protrusion 146 does not engage locking pin 138. Locking pin 138, actuating member 28 and the outside lever 11 (shown in FIG. 2) are then free to move. The latch bolt may then be withdrawn by movement of the outside lever 11 described hereinabove.

The locking plate is moved vertically between lower and upper positions by energizing one or both of main solenoids 110 and 111. The entire movement can be accomplished in tenths of a second. This is quite significant because the short time of energizing the solenoids minimizes battery drain. Main solenoids 110 and 111 are mounted on lock cassette body 29 by screw and bracket 155 and positioned to move the locking plate vertically between lower locked and upper unlocked positions. Main solenoids 110 and 111 may be of any suitable type. Preferably, main solenoids 110 and 111 are push type solenoids and have sufficient power to lift the locking plate as previously described.

The operation of the main solenoids must be synchronized with the operation of auxiliary solenoid 112. Auxiliary solenoid 112 may be of any suitable type; however, preferably, auxiliary solenoid 112 is a pull type solenoid. When the locking plate is in the lower locked position, shaft 150 of auxiliary solenoid 112 is perpendicular to the locking plate and received in a slot 151 at the top of the locking plate. Shaft 150 effectively prevents the locking plate from being moved vertically into the upper position. Thus, shaft 150 must be withdrawn immediately prior to the lifting of the locking plate by one or both of main solenoids 110 and 111.

Figure 5:
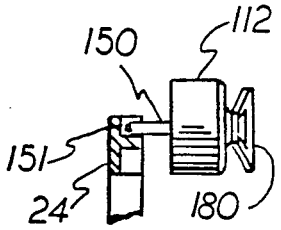
Figure 6:
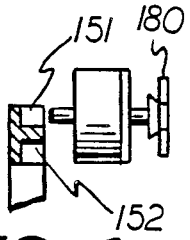
Figure 8:
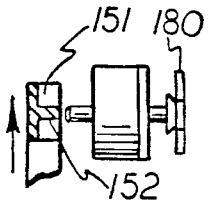
Figure 9:
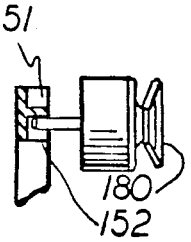

FIG. 5 depicts shaft 150 of auxiliary solenoid 112 positioned in slot 151 of the locking plate and preventing upward movement of the locking plate. In this position, auxiliary solenoid 112 does not draw any power. After activation, shaft 150 is withdrawn from slot 151 and offers no obstruction to the upward movement of the locking plate, as shown in FIG. 6. Referring to FIG. 8, the locking plate is then moved upward by the action of one or both of main solenoids 110 and 111. FIG. 7 depicts the locking plate in the upper unlocked position with both main solenoids energized. Shaft 150 is extended into slot 152 of the locking plate by means of a spring 180 after the plate has moved past it. This is shown in FIG. 9. In this position, the locking plate rests on shaft 150 and is restrained from moving down. Referring to FIGS. 9 and 10, because the locking plate is resting on shaft 150, main solenoids 110 and 112 are not energized to maintain the locking plate in the upper position and the shafts 154 of main solenoids fall back to their initial position. FIG. 10 also shows that in the upper unlocked position the locking pin 138 can be moved past protrusion 146 of nose piece 25. Aperture 120 of pinion 23 is free to rotate which will rotate spindle 51 and withdraw the latch bolt of latch mechanism 50. Extension spring 131 pulls the actuating member and lever 11 back to their initial positions after the operation.

When it is desired to move the locking plate from the upper unlocked position to the lower locked position the main and auxiliary solenoids are again activated in a synchronized manner. One or both of main solenoids 110 and 111 are energized and they lift the locking plate over shaft 150 of auxiliary solenoid 112. Auxiliary solenoid 112 is energized and shaft 150 is withdrawn. Power is cut to the main solenoids and the locking plate falls to the lower locked position. Spring 180 then forces shaft 150 of auxiliary solenoid 112 to extend into slot 151 at the top of the locking plate as discussed previously. The entire operation takes less than one second.

A microswitch 31 is positioned so that it is actuated by movement of the locking plate between the upper and lower positions. The purpose of this microswitch is to provide information as to the status of the lock, i.e., locked or unlocked, to the electronic and logic circuitry. As shown in FIG. 1, microswitch 31 may suitably be located on the outside corner 30 on which the electronic module containing the electronic and logic circuitry is located.

The operation of the locking plate mechanism allows a lock incorporating such mechanism to be suitable for a variety of functions. For example, such a lock can perform the hotel or storeroom function in a manner more advantageous than previous devices. As described above, the hotel function requires a lock to open and remain opened for a predetermined time period such as 3–6 seconds. Previously known devices would therefore draw power and deplete their batteries for the entire length of time the lock remained opened. With the present locking mechanism the hotel function would be accomplished by first moving the locking plate from the lower to the upper position. As previously described, this operation takes tenths of a second. Second, the locking plate would then remain in the upper or unlocked position for the desired time period without drawing power. Finally, the locking plate would be moved from the upper to the lower position. Again, as previously described, this would only draw power for the tenths of a second that it takes to accomplish this operation. In this manner, the present mechanism saves power while performing the hotel or storeroom functions because it draws power for less than one second while remaining open for the required 3–6 seconds. This is an especially significant feature for a battery operated lock. In contrast, previously known devices would draw power for the entire 3–6 seconds that the lock remained opened.

The locking mechanism of the present invention can also be adapted to perform a dormitory or classroom function, in which the lock can remain open for indefinite periods of time. This can also be accomplished with a minimum power draw. As previously described, moving the locking plate from the lower locked position to the upper unlocked position will require a power draw of tenths of a second. Also, the locking plate can be maintained in the upper or unlocked position without drawing power at all.

Other functions which are known to the art can be performed by the present locking mechanism. These include the institution, office and communicating functions. Differences between the various functions are effected by changes in the electronic and logic circuitry.

The inside operating portion is similar to the outside operating portion described above. The inside operating portion includes basically the same lock cassette body, actuating member, cam plate, rack plate and pinion and back plate elements as the outside operating assembly. The main difference of significance is that for all functions except institution and communicating functions there is no locking plate or solenoids associated therewith on the inside to prevent movement of the actuating member. For the institution and communication function, the inside operating assembly 60 is identical to outside operating assembly 20, i.e. it contains the locking plate and solenoids. Operation of the inside operating assembly from turning the lever through withdrawing the lock bolt assembly is the same as that of the outside operating mechanism.

Figure 3:
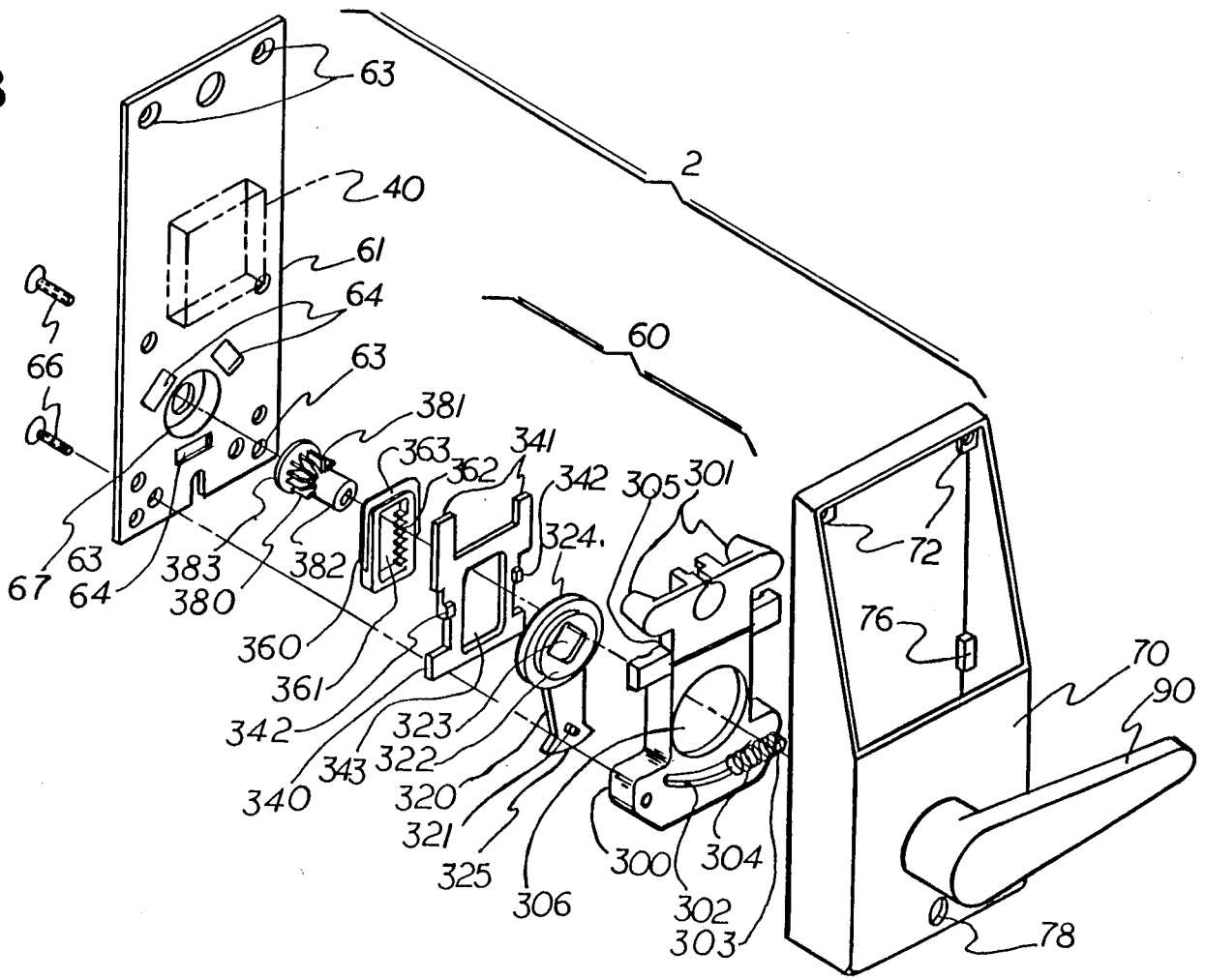
FIG. 3 is an exploded view of the inside portion of an electronic lock according to the present invention.

Referring to FIG. 3, the inside operating assembly 60 without solenoid and locking plate is described in greater detail. The inside operating assembly comprises a lock cassette body 300, an actuating member 320, a cam plate 340, a rack plate 360, and a pinion 380. The outside operating assembly is attached to back plate 61 by screws 66 into threaded holes in bosses 301 on lock cassette body 300.

Back plate 61 contains holes 63 through which it may be attached by screws (shown in FIG. 1) to tabs 72 and bosses in housing 70. The back plate 61 also contains tabs 64 to align the assembly with a standard hole provided in the door. Back plate 61 is also provided with boss 67 which extends inwardly and provides a bearing surface for head 383 of pinion 380.

Housing 70 features a central opening into which a generally square shaped projection of inside lever 90 extends. Tabs 76 are positioned so that projecting legs of the inside cover 80 can rest and maintain the cover in a generally horizontal position for servicing or changing battery means 40, which is located on back plate 61 just underneath inside cover 80. Housing 70 includes tabs 72 and bosses for attaching the back plate 61 to which the inside operating assembly has been attached.

Battery means 40 comprises any suitable battery but preferably comprises a 9-volt battery, or a 3-battery pack, each a 3-volt, 2/3A size or a six battery pack, each 1.5-V alkaline AA size. The battery is attached to back plate 61 by means of a spring clip (not shown). A battery cover may be utilized if desired. Wires (not shown) connect battery means 40 to the electronic and logic circuitry. The preferred electronic circuitry is described in application Ser. No. 099,921 filed on an even date herewith and entitled "Control for Electronic Lock", the contents of which are incorporated by reference. It is particularly preferred to also employ means to monitor battery power of the type described in Ser. No. 031,712, filed Mar. 27, 1987, now U.S. Pat. No. 4,724,426 issued May 3, 1988 entitled "Curtailed Power Delivery in Electronic Lock", the contents of which are incorporated by reference. Lock cassette body 300 includes a slot 302 through which actuator pin 321 of actuating member 320 fits. A spring mounting pin 303 is included on the outward side of lock cassette body 300.

Extension spring 304 fits onto the actuator pin 321 and spring mounting pin 303. Vertical sides 305 define a pathway which accommodates projecting arms 341 of cam plate 340. Body 300 also features an opening 306 through which generally square shaped projection of inside lever 90 extends.

An actuating member 320 is mounted on the inward side of cassette body 300 with a boss 322 thereof mounted in opening 306 and actuator pin 321 fitting through slot 302. The actuator 320 includes a generally square shaped opening 323 into which extends the generally square shaped projection of lever 90. The actuator includes a circular shaped base portion 324 and a tail end 325 which supports the actuator pin 321. The base portion 324 is provided with a raised V-shaped cam surface (not shown) which extends inwardly past the plane of the inner surface of tail end 325.

Cam plate 340 contains projecting arms 341 which fit into the pathway defined by vertical sides 305 of lock cassette body 300. The cam plate 340 also includes follower surfaces 342 which engages the V-shaped cam of actuator 300. Cam follower surfaces 342 are tabs projecting from the cam plate. Generally rectangular internal cutout 343 of cam plate 340 is sized to accommodate rack plate 360.

Rack plate 360 is mounted within the cutout 343 of cam plate 340. Rack plate 360 has a generally rectangular internal cutout 361 which cutout contains gear teeth 362 on one of the longer or vertical sides. Gear teeth 362 engage teeth 381 of pinion 380. Rack 360 has lip 363 upon its upper portion which serves to hold rack plate 360 in place between cam plate 340 and back plate 61.

Pinion member 380 includes gear teeth 381 in mating engagement with the teeth 362 on rack 360. The pinion member 380 extends perpendicularly to the axis of the latch bolt assembly 50. Pinion member 380 also includes a tubular extension portion 382 which extends through rack plate 360, cam plate 340, actuator 320 and cassette body 300 into an opening in outside lever 90. The pinion 380 further includes head portion 383 which is contained within boss 67 which extends inwardly on back plate 61 and provides a bearing surface for head portion 383. The head portion 383 also has a generally rectangular slot therein of mating cross section with that of spindle 51 of latch assembly 50 which extends therethrough (shown in FIG. 1).

Referring to FIGS. 1 and 3, hole 78 is provided in inside cover 70 to receive screw 100 and thus hold together the entire mechanism when located on a door. Inside cover 80 includes a hole to receive screw 101 and is held in place by the screw and legs 81. Movement of the inside lever 90 will withdraw the latch bolt as follows. Turning the lever 90 rotates the square shaped projection on the inside thereof which rotates actuator 320, which in turn moves cam plate 340 in a vertical direction. The movement of cam plate 340 carries with it rack 360. As rack 360 moves upwardly it causes pinion 380 to rotate, thus rotating spindle 51 and withdrawing the latch bolt of latch assembly 50.

I claim:

1. A locking mechanism for an electronic door lock which comprises:

a locking plate moveable between a locked position and an unlocked position;

a source of electrical power;

main solenoid means selectively connected to said source of power for moving said locking plate between locked and unlocked positions;

auxiliary solenoid means selectively connected to said source of power and located perpendicular to said locking plate for retaining said locking plate in either the locked or unlocked positions when disconnected from the source of power.

2. The locking mechanism according to claim 1 wherein said main solenoid means comprises two main solenoids positioned on either side of said locking plate.

3. The locking mechanism according to claim 1 wherein said locking plate comprises a top plate and a nose piece.

4. The locking mechanism according to claim 3 wherein said top plate is produced from a light weight plastic material.

5. The locking mechanism according to claim 3 wherein said nose piece is produced from hardened steel.

6. The locking mechanism according to claim 1 wherein said locking plate includes slots positioned to accept a shaft of the auxiliary solenoid.

7. An electronic lock comprising:

an outside housing having a slot to accept a card key;

card reader means to read said card and generate an electronic signal;

circuitry means to accept said electronic signal from the card reader means and generate signals to the electronic locking mechanism;

an electronic locking mechanism which comprises a locking plate moveable between a lower locked position and an upper unlocked position, main solenoid means for moving said locking plate between lower and upper positions, auxiliary solenoid means located perpendicular to said locking plate and adapted to maintain said locking plate in either the upper or lower positions without drawing power;

a latch bolt assembly;

outside and inside mechanical operating means adapted to operate said latch bolt;

power source means to provide power to said circuitry means and solenoid means; and an inside housing.

8. The electronic lock according to claim 7 wherein said outside mechanical operating means comprises a lock cassette body which supports said main and auxiliary solenoid means, an actuating member, a cam plate, a rack plate and a pinion.

9. The electronic lock according to claim 7 wherein said inside mechanical operating means comprises a lock cassette body, an actuating member, a cam plate, a rack plate and a pinion.

10. The electronic lock according to claim 8 wherein said rack plate is positioned to move within a square shaped cutout of said locking plate without affecting the position of said locking plate.

11. A locking mechanism for an electronic door lock which comprising:

a source of electrical power;

locking means movable between a locked position and an unlocked position;

electrically actuated means selectively connected to said source of power for moving said locking means between said locked and unlocked positions; and electrically powered holding means selectively connected to said source of power for maintaining said locking means in said locked or unlocked positions when the holding means is disconnected from said source of power.

12. A locking mechanism in accordance with claim 11 wherein said locking means comprises a plate, said electrically actuated means comprises a pair of electrically actuated solenoids and said holding means comprises a third electrically actuated solenoid, with supply of electrical energy to said third solenoid terminating the maintaining function thereof.

* * * * *